US008978618B2

(12) United States Patent
Davis

(10) Patent No.: US 8,978,618 B2
(45) Date of Patent: Mar. 17, 2015

(54) HEAT ENGINE

(76) Inventor: Brian Davis, Ripon, WI (US)

( * ) Notice: Subject to any disclaimer, the term of this patent is extended or adjusted under 35 U.S.C. 154(b) by 40 days.

(21) Appl. No.: 13/469,306

(22) Filed: May 11, 2012

(65) Prior Publication Data

US 2012/0288391 A1 Nov. 15, 2012

Related U.S. Application Data

(60) Provisional application No. 61/485,849, filed on May 13, 2011.

(51) Int. Cl.

| | |
|---|---|
| ***F02B 53/12*** | (2006.01) |
| ***F01C 1/22*** | (2006.01) |
| ***F01C 19/02*** | (2006.01) |
| ***F01C 21/18*** | (2006.01) |

(52) U.S. Cl.

CPC . *F01C 1/22* (2013.01); *F01C 19/02* (2013.01); *F01C 21/18* (2013.01)

USPC ..... 123/210; 123/241; 418/60; 60/518; 60/519

(58) Field of Classification Search

USPC ..... 123/210, 241; 60/518, 519, 682; 418/60

See application file for complete search history.

(56) References Cited

U.S. PATENT DOCUMENTS

| | | | | |
|---|---|---|---|---|
| 658,556 | A | | 9/1900 | Pitt |
| 2,988,065 | A | | 6/1961 | Wankel |
| 3,426,525 | A | | 2/1969 | Rubin |
| 3,483,694 | A | | 12/1969 | Huber |
| 3,509,718 | A | | 5/1970 | Fezer et al. |
| 3,698,184 | A | | 10/1972 | Barrett |
| 3,762,167 | A | | 10/1973 | Wahnschaffe et al. |
| 3,763,649 | A | | 10/1973 | Wahnschaffe et al. |
| 3,800,526 | A | | 4/1974 | Wahnschaffe et al. |
| 3,811,272 | A | | 5/1974 | Hakansson |
| 3,830,059 | A | | 8/1974 | Spriggs |
| 3,924,578 | A | * | 12/1975 | Howard ..... 123/228 |
| 3,958,421 | A | | 5/1976 | Kelly |
| 3,990,239 | A | | 11/1976 | Pattas et al. |
| 4,044,559 | A | | 8/1977 | Kelly |
| 4,059,370 | A | | 11/1977 | Gibson |
| 4,103,491 | A | | 8/1978 | Ishizaki |
| 4,179,890 | A | | 12/1979 | Hanson |
| 4,206,604 | A | | 6/1980 | Reich |
| 4,240,256 | A | | 12/1980 | McDougal |

(Continued)

FOREIGN PATENT DOCUMENTS

| | | |
|---|---|---|
| DE | 4119242 | 6/1992 |
| WO | 8606437 | 6/1986 |

*Primary Examiner* — Thomas Denion
*Assistant Examiner* — Thomas Olszewski
(74) *Attorney, Agent, or Firm* — Brannen Law Office, LLC

(57) ABSTRACT

The present invention relates to a heat engine having a housing. A generally triangular shaped rotor can drive an offset crank as it eccentrically rotates within the housing. Two inlets with valves and two exhausts are provided. The volume between each face of the rotor and the housing defines three expansion chambers. Six power cycles are provided (one by each expansion chamber times two inlets) per revolution of the rotor. Each valve controls the length of time that high pressure gas is allowed to enter each expansion chamber. The valves are controlled by a processor and close when enough pressure is supplied so that the pressures inside and outside the expansion chamber are equal when the chamber is fully expanded just prior to exhaust. Gates can provide a mechanical advantage to the rotor by reducing the amount of pressure applied to the back side of the fulcrum.

10 Claims, 22 Drawing Sheets

(56) References Cited

U.S. PATENT DOCUMENTS

| | | | | | |
|---|---|---|---|---|---|
| 4,357,800 | A | | 11/1982 | Hecker | |
| 4,380,909 | A | | 4/1983 | Sung | |
| 4,721,086 | A | | 1/1988 | Scarnera et al. | |
| 4,753,073 | A | | 6/1988 | Chandler | |
| 4,760,701 | A | | 8/1988 | David | |
| 5,165,238 | A | * | 11/1992 | Paul et al. | 60/682 |
| 5,168,846 | A | | 12/1992 | Paul et al. | |
| 5,211,017 | A | | 5/1993 | Pusic | |
| 5,325,671 | A | | 7/1994 | Boehling | |
| 5,335,497 | A | | 8/1994 | Macomber | |
| 5,410,998 | A | | 5/1995 | Paul et al. | |
| 6,109,040 | A | | 8/2000 | Ellison, Jr. et al. | |
| 6,758,188 | B2 | | 7/2004 | Wooldridge | |
| 6,834,503 | B2 | | 12/2004 | Freymann | |
| 7,669,415 | B2 | | 3/2010 | Komaki et al. | |
| 8,312,859 | B2 | * | 11/2012 | Rom et al. | 123/213 |
| 2004/0050358 | A1 | | 3/2004 | Harrison | |
| 2007/0113560 | A1 | | 5/2007 | Steber et al. | |
| 2007/0234719 | A1 | | 10/2007 | Schuster et al. | |
| 2008/0190395 | A1 | | 8/2008 | Rom et al. | |
| 2009/0056670 | A1 | | 3/2009 | Zhao et al. | |
| 2009/0139227 | A1 | * | 6/2009 | Nakasuka et al. | 60/517 |
| 2009/0313989 | A1 | | 12/2009 | Doss | |
| 2010/0089062 | A1 | | 4/2010 | Cao | |
| 2010/0300097 | A1 | | 12/2010 | Van De Loo et al. | |
| 2011/0126794 | A1 | * | 6/2011 | Higashi et al. | 123/241 |

* cited by examiner

HEAT ENGINE

This patent application claims priority on and the benefit of U.S. provisional application 61/485,849 filed May 13, 2011, the entire contents of which are hereby incorporated herein by reference.

BACKGROUND OF THE INVENTION

1. Field of the Invention

The present invention relates to a heat engine, and in particular to a rotary style heat engine operating with increased efficiency.

2. Description of the Related Art

Heat energy, sometimes called thermal energy, is defines as the kinetic energy of a system's particles. Put another way, the heat energy of a system is the amount of potential energy in a system that is derived from the heat content within the system.

Temperature is not the same as heat energy. Yet, temperature makes up an integral part of the ideal gas law. The ideal gas law states:

$$PV=nRT$$

Wherein:

P is Pressure

V is Volume n is the amount of gas

R is the universal gas constant and

T is temperature

This ideal gas law demonstrates that temperature and pressure are directly related when the other variables are held constant. Likewise, when temperature is held constant in a closed system, the pressure and volume are inversely related. This is demonstrated as follows:

$$P1*V1=P2*V2$$

That is, the sum of pressure times volume stays constant in a closed system and when the temperature remains constant.

It is known that pressure within a system can be used to perform work. For example, in a properly designed system, potential energy of a high pressure container can be extracted by allowing a user to convert potential energy to kinetic energy.

As an example, consider a tank that is under pressure two times atmospheric pressure. The gas will rush out of the tank when a valve is opened until the pressures inside and outside of the tank equalize. Stating this differently, the gas inside the tank expands (from inside to outside the tank) until the pressures equalize. The expansion of the gas can be utilized to perform work.

There have been many engine designs over the years. One design is the Wankel, engine design. The Wankel engine is a four-cycle internal combustion engine that uses a rotating rotor motion instead of reciprocating pistons. The four cycles takes place between a Reuleaux triangle shaped rotor and an epitrochoid-shaped housing.

The housing can be defined as having 360 degrees of rotation. The rotor can generally be described as an equilateral triangle with rounded faces. The sum of internal angles of an equilateral triangle is 180 degrees. In this regard, the rotor revolves around an offset crankshaft wherein the apexes of the rotor contact the housing at all times. An example of this engine 5 design is shown in FIG. 1.

A single rotor engine is considered a three cylinder engine. In this regard, the space or volume between the apexes of the triangle and the housing wall define three chambers. Each chamber acts independently of the other chambers and each undergoes the intake, compression, ignition and exhaust cycles of the four-cycle design. Hence, three power cycles are produces by this engine.

The Wankel engine has been modified in many ways. Some modifications of the Wankel design, as well as examples of other designs are illustrated in the following patents and published application.

U.S. Pat. No. 3,426,525 to Rubin is titled Rotary Piston External Combustion Engine.

U.S. Pat. No. 3,509,718 to Fezer et al. is titled Hot Gas Machine.

U.S. Pat. No. 4,206,606 to Reich is titled Rotary Stirling Cycle Engine. It discloses a rotary Stirling cycle machine comprising at least two chambers, said chambers being epitrochoidal in cross-sectional area and having an upper portion, a middle waist portion and a lower portion, with the first chamber mounted to the second chamber in tandem, each chamber having a seal element attached to the waist portion and disposed inwardly, the crank shaft rotatably mounted within the chambers and extending therethrough with the first crank throw portion within the first chamber being 180.degree. out of phase with the second crank throw portion within the second chamber, the first and second rotor elements rotatably mounted on said respective crank throw portions with each rotor element being limicon shaped in circumference and adapted to register with the upper and lower portions of the respective chambers so that the rotor elements cyclically rotate about the rotating crank shaft from a position in registration with the upper portion to a position in registration with the lower portion, said seal elements being in constant sealing engagement with the respective rotor elements to define first cavities in the upper portions and second cavities in the lower portions, and heater-regenerator-cooler means operatively connected to said first and second cavities to condition a working fluid through repeated Stirling cycles.

U.S. Pat. No. 4,357,800 to Hecker is titled Rotary Heat Engine. It teaches a rotary external combustion heat engine for furnishing mechanical energy from a source of heat. The engine includes a ring-like stator having an oval rotor chamber enclosing a cylindrical rotor eccentrically placed within the chamber to define a high displacement high temperature fluid chamber and a lower displacement low temperature fluid chamber. A plurality of extensible vanes extend outwardly from the rotor in sliding contact with the inner surface of the rotor chamber. A source of heat supplies thermal energy to fluid supplied to the high temperature chamber, while a heat sink cools fluid supplied to the low temperature chamber. An economizer heat exchanger is also provided for preheating the working fluid. The relative position of the rotor within the rotor chamber is adjustable for varying the relative displacement of the fluid chambers to control engine working parameters. In another embodiment, a first heat engine is utilized as a motor and is mechanically coupled to a second heat engine utilized as a heat pump for providing an external combustion heat pump or refrigeration unit.

U.S. Pat. No. 4,760,701 to David is titled External Combustion Rotary Engine. The patent describes an external combustion rotary engine comprising a motor member, a free-piston combustion member and a storage tank serving also as a heat exchanger and located between the motor and the combustor. The motor rotors rotate inside an enveloping structure eccentrically with respect to a power shaft to form alternatively compression and expansion chambers. Compressed air produced thereby is ducted first to the storage tank and then to the combustor for burning fuel to produce combusted gases which are in turn ducted to the storage tank where heat is exchanged between the hot gases and the cooler compressed air. The combusted gas is then expanded in the expansion chambers. A fraction of the compressed air is further compressed to a higher pressure level so that it may be used in air pad cushions to isolate the various engine rotating parts from the fixed structures surrounding them. The use of such air cushions prevents contacts between moving parts and eliminates friction, heat production therefrom and wear. The need for lubrication is thus also eliminated. The "externally" performed fuel combustion is much slower than in comparable internal combustion rotary engines. This results in higher combustion efficiencies, lower combustion temperatures and lower rates of production of pollutants such as NO.sub.x.

U.S. Pat. No. 5,211,017 to Pusic is titled External Combustion Rotary Engine. It shows an external combustion rotary engine having a configuration which allows spatial separation of the heaters and coolers, and a process which enables rotary motion of the rotors to be performed without internal combustion. The engine includes the triangular rotors enclosed inside the housings shaped in the form of an epitrochoid curve, the heat generating units, and the heat absorbing and discharging units. The heat generating units and the heat absorbing and discharging units are located outside the housings and connected to the housings. The engine can also include the ultrasonic fuel atomizers inside the heat generating units and the turbine for the purpose of rapid acceleration. The present invention provides the simple, compact, lightweight, extremely energy-efficient and environmentally clean engine.

U.S. Pat. No. 5,325,671 to Boehling is titled Rotary Heat Engine. It describes an engine energized by an external heat source and cooled by an external cooling source, driven by a closed body of gas contained in chambers of variable volume and passages connected thereto, and operating on a Carnot cycle. The apparatus of the engine also has heat pump capabilities.

U.S. Pat. No. 6,109,040 to Ellison, Jr. et al. is titled Stirling Cycle Refrigerator or Engine employing the Rotary Wankel Mechanism. It illustrates a non-reciprocating Stirling-cycle machine which overcomes problems associated with high drive mechanism forces and vibration that seriously hamper reciprocating Stirling-cycle machines. The design employs Wankel rotors instead of the reciprocating pistons used in prior Stirling machines for effecting the compression and expansion cycles. Key innovations are the use of thermodynamic symmetry to allow coupling of the rotating compression and expansion spaces through simple stationary regenerators, and the coordination of thermodynamic and inertial phasing to allow complete balancing with one simple passive counterweight, which is not possible in reciprocating machines. The design can be scaled over a wide range of temperatures and capacities for use as a cryogenic or utilitarian refrigerator or to function as an external heat powered engine.

United States Patent Application Publication 2009/0139227 to Nakasuka et al. is titled Rotary Heat Device. It has a rotary heat engine having a cylinder and a rotor having a rotating shaft rotatably placed in the cylinder. The cylinder has a heat receiving section for supplying heat to the inside of the cylinder and a heat radiating section for radiating heat from the inside. The engine also has an engine section body and an operation liquid storage section. A vaporized gas supply channel and a gas recovery channel communicating with the inside of the cylinder are provided, respectively, on the heat receiving section side and heat radiating section side of the cylinder in the engine section body. The operation liquid storage section is between the vaporized gas supply channel and the gas collection channel in order to aggregate and liquefy recovered gas and is installed such that both channels fluidly communicate with each other. Also, the operation liquid storage section has a heat insulation dam provided with a through hole for preventing backflow of fluid flowing inside.

While each of these devices may be useful for their intended purposes, none show the unique advantages of the present invention.

Specifically none show an engine utilizing an elongated driving force due to opening of a valve when one of three apexes passes a prior exhaust port and the expansion chamber volume is small.

None show that an input valve can be closed at the appropriate timing whereby pressure in the expansion chamber and the pressure in the system outside of the expansion chamber will be approximately equal when the rotor leading apex passes the exhaust port.

Due to the geometry of adding a second inlet and exhaust ports, modified engines suffer from blow-by at certain times. The blow-by occurs as an expansion chamber will be open to both the inlet and exhaust simultaneously. None show the use of valves to prevent blow-by in a system having three apexes of a triangular rotor and two inlets and two exhaust ports spaced about the engine housing.

None show the use of fixed gates mounted in the housing to decrease expansion chamber volume and increase the portion of driving force about one side of a rotor as the rotor orbits about the housing center point.

Thus there exists a need for a heat engine that solves these and other problems.

SUMMARY OF THE INVENTION

The present invention relates to a heat engine having a housing. A generally triangular shaped rotor can drive an offset crank as it eccentrically rotates within the housing. Two inlets with valves and two exhausts are provided. The volume between each face of the rotor and the housing defines three expansion chambers. Six power cycles are provided (one by each expansion chamber times two inlets) per revolution of the rotor. Each valve controls the length of time that high pressure gas is allowed to enter each expansion chamber. The valves are controlled by a processor and close when enough pressure is supplied so that the pressures inside and outside the expansion chamber are equal when the chamber is fully expanded just prior to exhaust. Gates can provide a mechanical advantage to the rotor by reducing the amount of pressure applied to the back side of the fulcrum.

According to one advantage of the present invention, the engine utilizes an elongated driving force due to opening of a valve when one of three apexes passes a prior exhaust port and the expansion chamber volume is small. The faces of the rotor are smooth and undished in order to minimize the volume in each chamber when the valve first opens.

According to another advantage of the present invention, the input valve can be closed at the appropriate timing whereby pressure in the expansion chamber and the pressure in the system outside of the expansion chamber will be approximately equal when the rotor leading apex passes the exhaust port. In this regard, the efficiency of the expansion phase is maximized because all of the energy is utilized as the pressures are equalized when the system opens to the exhaust.

According to further advantage of the present invention, the use of valves prevents blow-by in the system. Blow-by would otherwise occur in a system having three apexes of a triangular rotor and two inlets and two exhaust ports spaced about an engine housing since at times in the revolution of the rotor a chamber would be open to both an inlet and an exhaust port at the same time. Using a valve prevents this occurrence from happening.

According to a still further advantage of the present invention, fixed gates are provided to decrease expansion chamber volume (start of the expansion) and also to increase the mechanical advantage of the rotor during the expansion (the portion of driving force about one side of a rotor as the rotor orbits about the housing center point). The side of the rotor upon which driving force acts is called the positive side of the fulcrum. Further, the undished face allows the gates to fully divide the expansion chambers into two portions due to being able to fully engage the rotor.

The gates can have a selected angular alignment whereby pressure within the expansion chamber acts to force the gates against the rotor face to form a strong seal.

The use of gates also allows the exhaust ports to be moved to different locations about the housing. In one embodiment, the pressure can be applied over about 30 degrees of rotation. However, by adding the gate and moving the outlet, the pressure can be applied over approximately 70 degrees of rotation, greatly increasing the driving force applied to the rotor.

According to a still further advantage of the present invention, the engine has six power cycles per revolution. This is due to three expansion chambers and two inlets. Each power cycle is offset from each other, whereby the combined power curve is smoothed out.

According to a still further advantage of the present invention, a processor is provided to control the opening and closing of the valves. The opening will be at a set point when the volume in the expansion chamber is at or near a minimum. The processor interprets both the input and exhaust pressures and closes the input valve at an exact time which allows for the high pressure gas entering the chamber to fully expand and be approximately equal to the pressure on the low pressure side of the system at exhaust.

According to a still further advantage of the present invention, a partial vacuum can be provided as the gas cools in the condensation chamber. This lower pressure can help to pull to rotor around its rotation.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
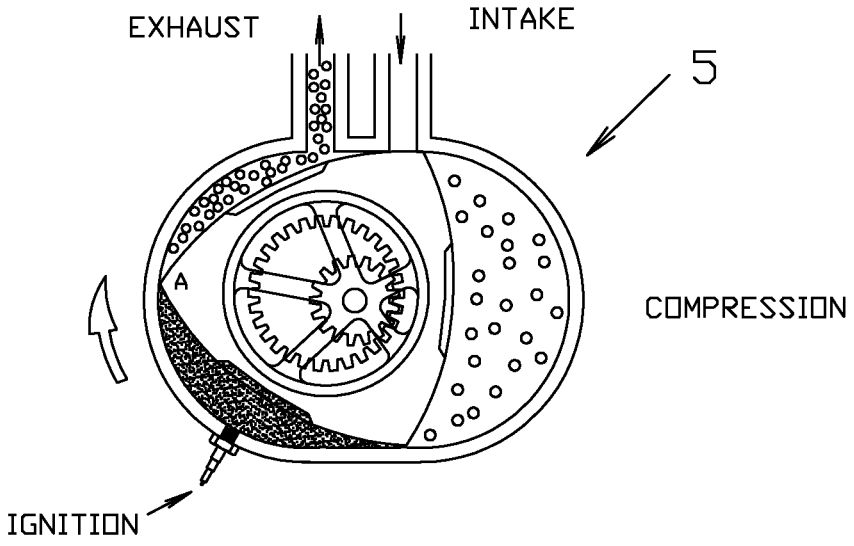
FIG. 1 PRIOR ART
FIG. 1 is a schematic view of a traditional Wankel style engine.
Figure 2A:
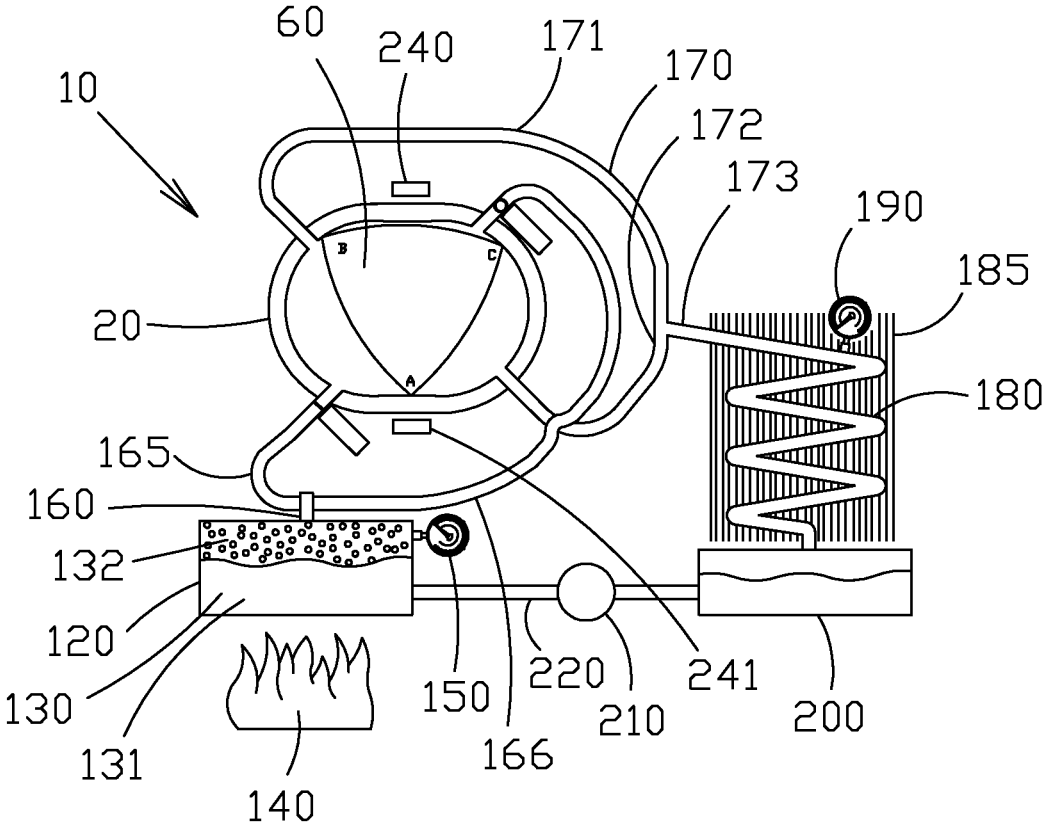
FIG. 2A is a schematic view of a preferred embodiment of the present invention.

Looking now to FIG. 2A, it is seen that an engine 10 is provided having a housing 20. A rotor 60 is further provided. The rotor 60 rotates within the housing 20 as described below.

A high pressure tank 120 is provided. The tank can be any suitable size. The tank 120 can hold a selected amount of working medium 130. The working medium is preferably a commonly available refrigerant that undergoes a phase change between liquid 131 and gas 132 at predictable temperatures and pressures. One preferred refrigerant is R-123. However it is understood that other refrigerants could be used without departing from the broad aspects of the present invention.

A heat source 140 is provided. The heat source 140 is in close proximity to tank 120, whereby the heat source can heat the working medium 120 causing selected amounts of liquid 131 to undergo a phase change to gas 132. The tank can hold the gas at high pressures. It is understood that operating pressures and temperatures are determined based on system requirements and refrigerants used. A gauge 150 is provided for measuring the pressure in the high pressure tank 120.

A high pressure delivery system 160 is provided. The high pressure delivery system 160 can be split into two lines, a first line 165 and a second line 166. The lines are fluidly connected wherein the pressure in each line 165 and 166 are preferably the same. The high pressure delivery system 160 provides high pressure gas to the housing 20 of the engine 10.

A low pressure exhaust system 170 is further provided. The low pressure exhaust system receives low pressure exhaust from the housing 20 of the engine. The low pressure exhaust system has a first line 171 and a second line 172. The first and second lines 171 and 172, respectively, combine in line 173.

The low pressure exhaust 170 goes through a condensation chamber 180 having a heat exchanger 185. The condensation chamber 180 has a gauge to measure pressure within the system on the low pressure side of the system. The condensation chamber 180 empties liquid condensate into a low pressure condensation tank 200. From there, a pump 210 is used to route liquid 131 back into the high pressure tank 120 to repeat the cycle.

Figure 2B:
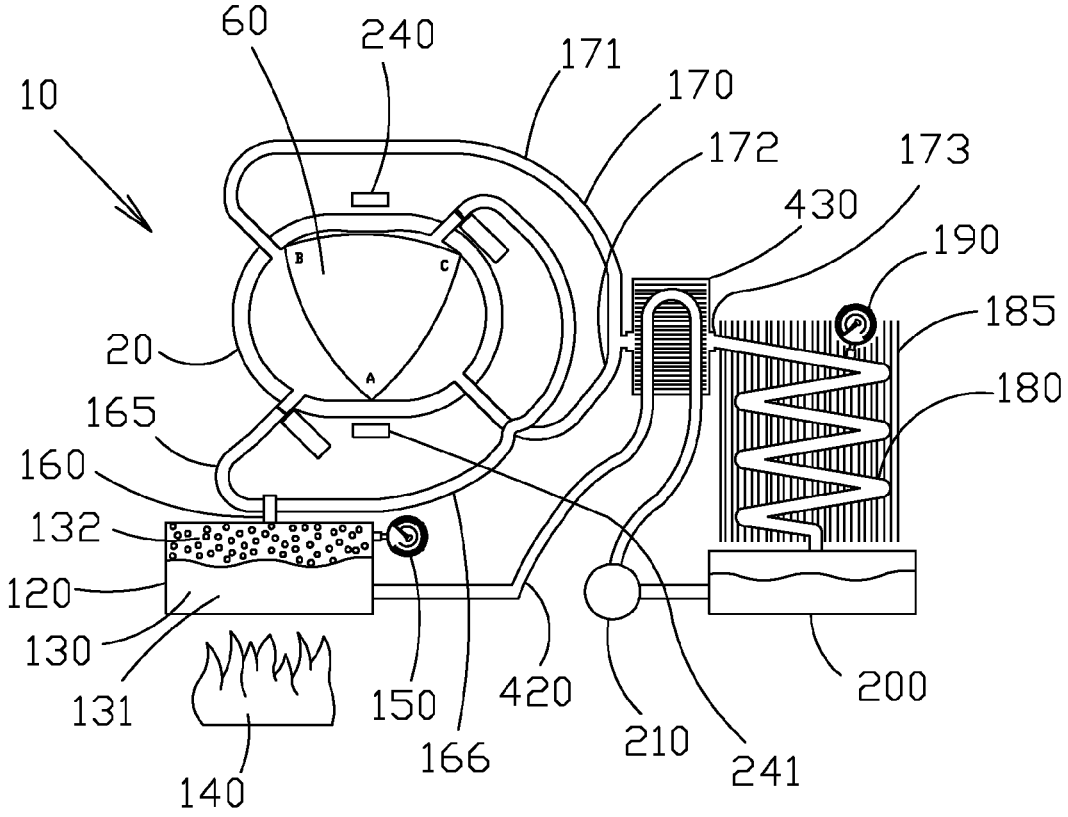
FIG. 2B is similar to FIG. 2A, but shows an additional reheat circuit between a pump and a high pressure tank.

Looking briefly at FIG. 2B, it is seen that an alternative line 420 can be provided to route liquid through a heat exchanger 421 prior to entering the high pressure tank to pre-heat the liquid.

Figure 3:
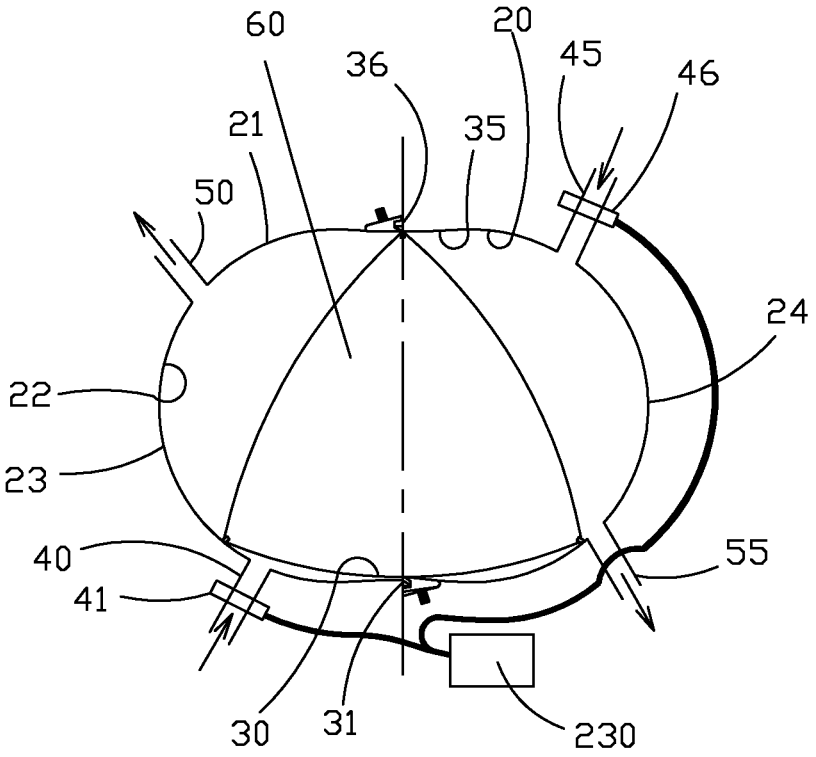
FIG. 3 shows a controller in electrical communication with a first valve and a second valve.

A processor 230 is provided. The processor 230 communicates with position sensors or locators 240 and 241 (which monitor the location of the rotor 60 within the housing 20). The processor 230, as seen in FIG. 3, is also in communication with valves 41 and 46, described below. The processor controls the opening and closing of the valves 41 and 46.

Turning now to FIGS. 4-15, it is seen how the rotor 60 moves about the housing 20.

The housing 20 has a wall 21 with an inside surface 22. The inside surface defines a general epitrochoid shaped structure having a first section 23 and a second section 24. The sections are generally open to each other, but have a first radius 30 and second radius 35 there between. The radii 30 and 35 protrude a small amount toward the center of the housing 20. The radii 30 and 35 have openings or recesses 31 and 36 respectively, to accommodate stationary gates (described below). The openings preferably span from the top to the bottom or the full dimension of the housing and are complimentary in shape to the respective gates. It is appreciated that the openings or recesses may not span the full dimension so long as they support gates that do span the entire dimension.

The housing has an inlet 40 with a valve 41, an inlet 45 with a valve 46, an outlet 50 and an outlet 55. The inlets 40 and 45 are spaced apart (preferably approximately 180 degrees on separate sides of the housing) and are separated by outlets 50 and 55. The valves 41 and 46 are preferably selectably opened and closed under the direction of the processor 230 based on the location of the rotor 60 within the housing 20.

Figure 20:
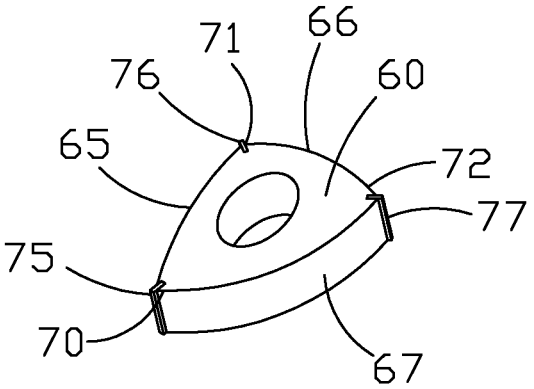
FIG. 20 is an isolation perspective view of a rotor showing smooth rotor faces.

The rotor 60 is generally reuleaux shaped. In this regard, the rotor 60 has three faces, namely a first face 65, a second face 66 and a third face 67. The faces meet at apexes, namely the apex A 70, apex B 71 and apex C 72. Seals 75, 76 and 77 are provided respectively at apex A 70, apex B 71 and apex C 72. The rotor 60 is shown prospectively in FIG. 20. Faces 65, 66 and 67 are preferably smooth and are formed without cavities or other recesses therein. In this regard, the faces travel closely to the inside surface 22 of the housing.

It is understood that the seals actually contact the housing, but for sake of simplicity in description, it is described herein as apex's passing certain points such as inlets and exhausts.

Figure 18:
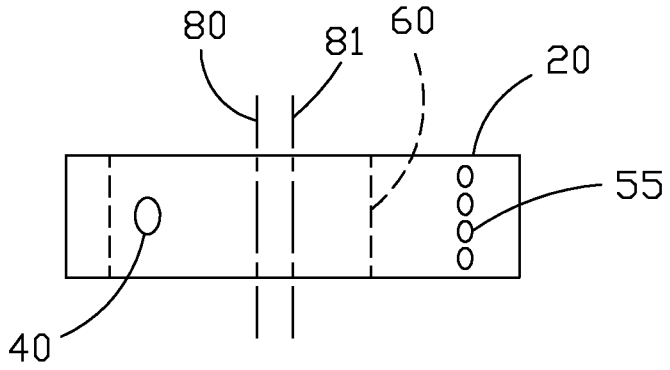
FIG. 18 is a side view of FIG. 17.

As is best seen in FIG. 18, the housing 20 has a center or fulcrum 81. The rotor has a center line 80 as well. The rotor center line 80 is offset from the fulcrum 81 a selected amount as the rotor 60 rotates in an eccentric manner about the housing 20. The frame of reference of the viewer determines the direction of rotation. For example, staying with FIG. 18, the rotor rotates in a clockwise direction within the housing. However, the direction of rotation would be opposite if the field of view likewise is opposite.

A first expansion chamber 90, a second expansion chamber 100 and a third expansion chamber 110 are provided. The expansion chambers are located between the rotor 60 and the housing 20. A driving force is provided in an expansion chamber due to the offset orientation of the fulcrum and the rotor center.

It is understood, looking at FIGS. 4-15, that one of the expansion chambers may be exposed to either the first inlet and first outlet or the second inlet and second outlet simultaneously. However, since the first inlet and second inlet both are valved (and can be closed) blow-by is prevented in the present invention as the respective valves will be closed when the condition exists when the expansion chambers are so exposed.

A gate 250 is provided and shown in FIGS. 4-15 and 24-26. Gate 250 is preferably removably received (via the top or bottom of the housing) within opening 31 of radius 30. Gate 250 has a first end 251 pivotally held within the opening 31 and an opposed second end 252 that contacts the rotor 60 at a tip. A face 253 is provided facing the rotor 60 and a back is provided facing the inside of the opening 31. A spring 255 is provided for biasing the gate end 252 away from the opening 31 and towards the rotor 60. A seal 256 is provided on the rear side of the gate. Gate 250 preferably spans the entire height of the housing 20. Gate 250 has a lip 257 that engages in inside wall of the opening to hold the gate 250 within the opening so that the gate cannot escape from the opening.

A gate 260 is further provided. Gate 260 is identical to gate 250. Gate 260 is removably received within opening 36.

As seen in FIGS. 27A-27E, the gate 250 preferably engages the rotor from approximately 20 degrees before top dead center until approximately 20 degrees after top dead center, and lets off the rotor at approximately 30 degrees after top dead center. The gate 250 bifurcates the expansion chamber when it contacts the rotor, whereby it prevents pressure from acting on the rotor behind the gate. Bifurcation or splitting of the expansion chamber into two parts is accomplished since the rotor faces are undished so that the gates can engage the rotor.

Figure 17:
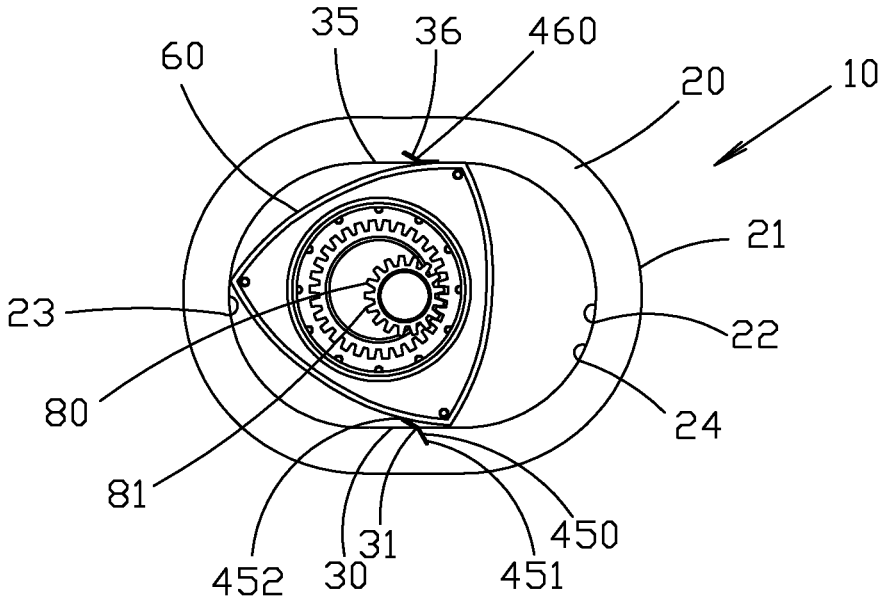
FIG. 17 is a top view of an embodiment of the present invention including an alternative gate structure.
Figure 22:
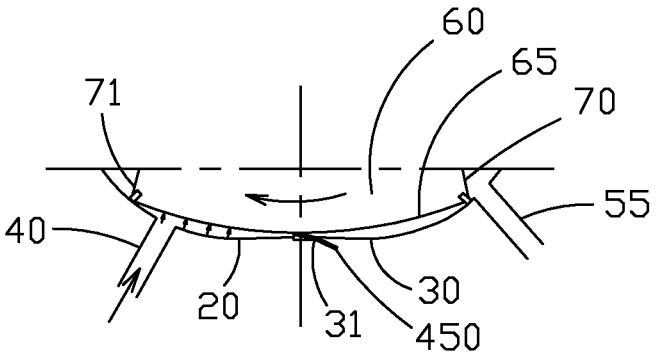
FIG. 22 is a close up view showing an alternative embodiment of a gate with the rotor in a selected position.
Figure 23:
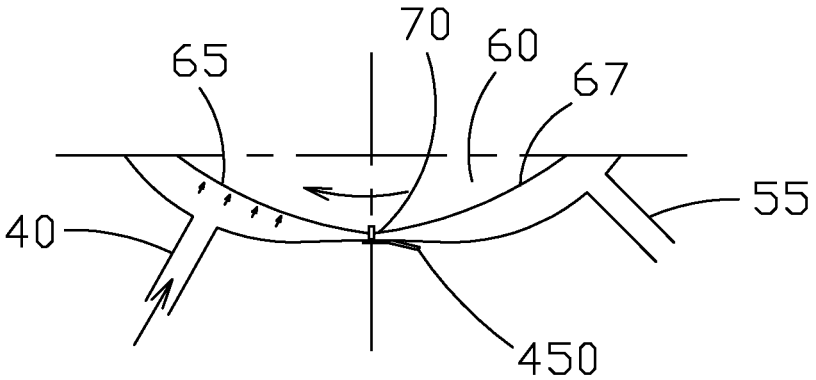
FIG. 23 is similar to FIG. 22, but shows the rotor in a different position.
Figure 24:
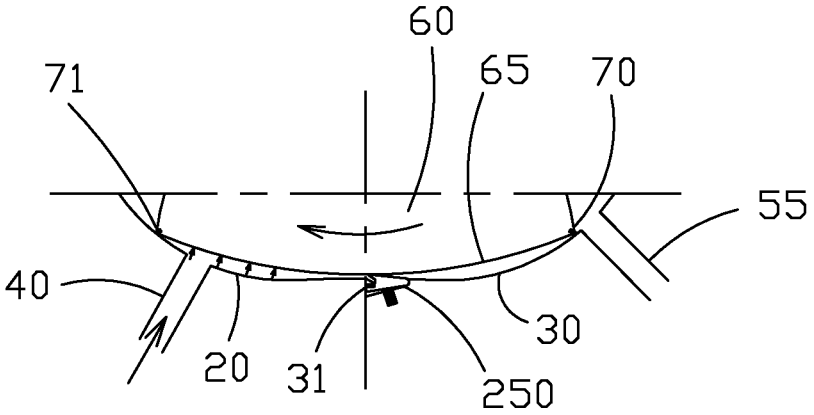
FIG. 24 is a close up view showing an alternative embodiment of a gate with the rotor in a selected position.
Figure 25:
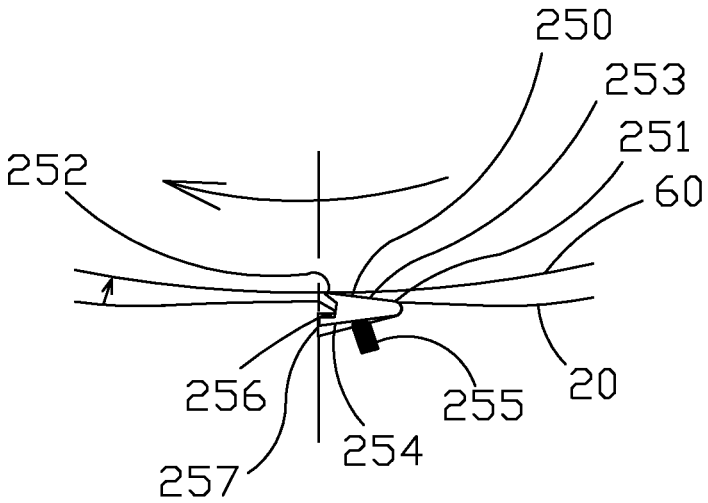
FIG. 25 is a close up view of the gate illustrated in FIG. 24.
Figure 26:
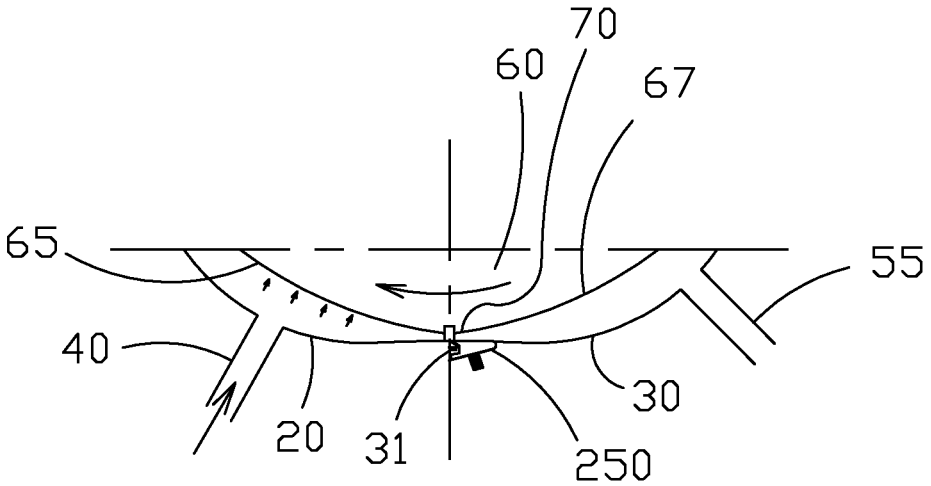
FIG. 26 is similar to FIG. 25, but shows the rotor in a different position.
Figure 27A:
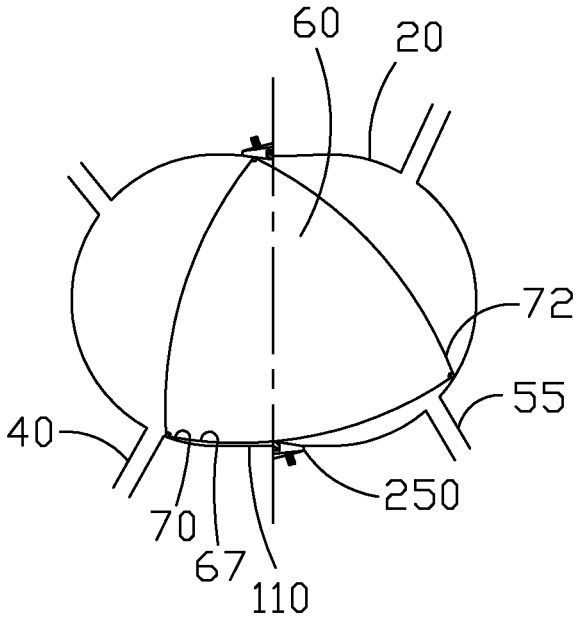
FIG. 27A is a schematic view with an apex approximately 20 degrees before top dead center.
Figure 27B:
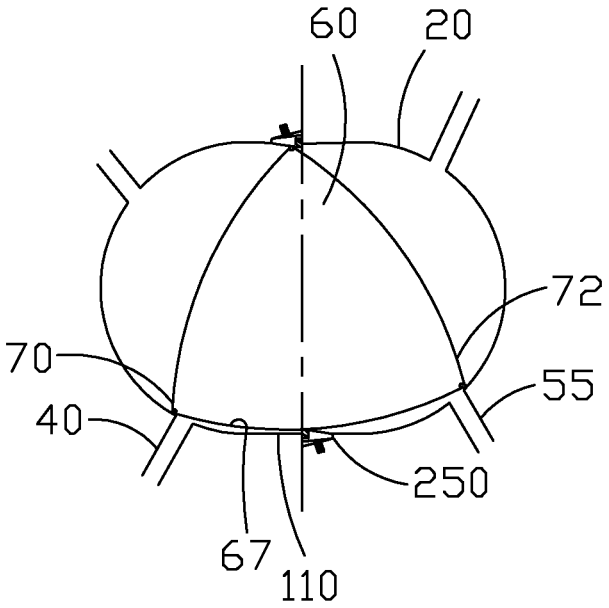
FIG. 27B is a schematic view with an apex approximately 10 degrees before top dead center.
Figure 27C:
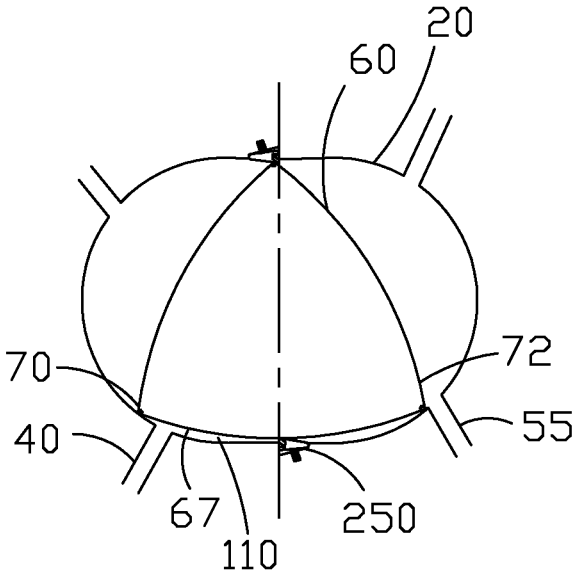
FIG. 27C is a schematic view with an apex approximately at top dead center.
Figure 27D:
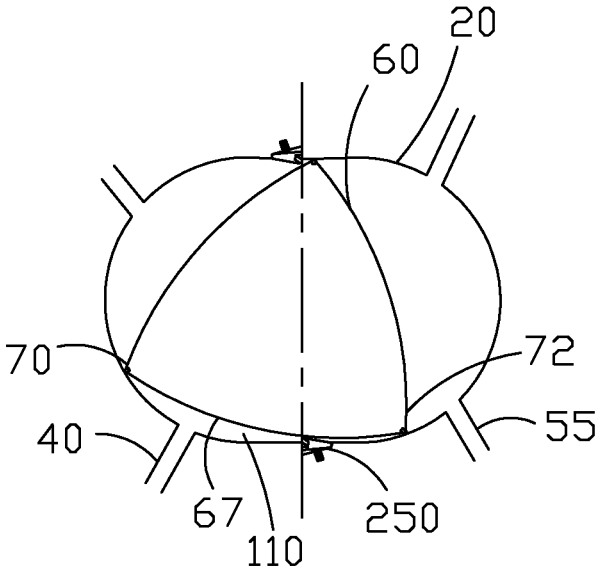
FIG. 27D is a schematic view with an apex approximately 10 degrees after top dead center.
Figure 27E:
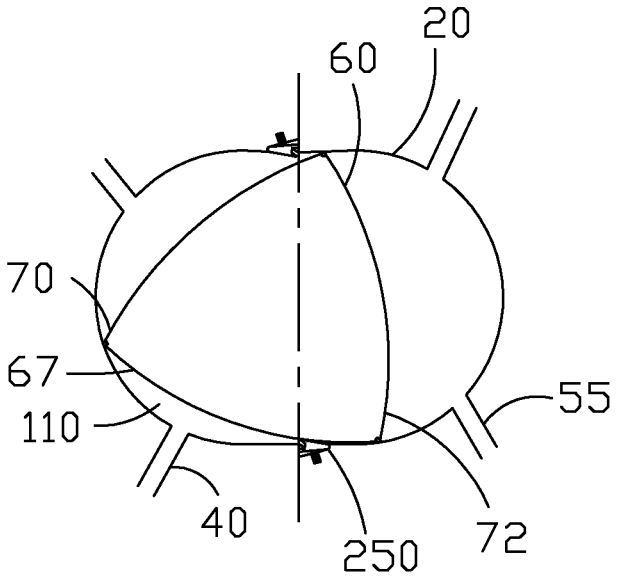
FIG. 27E is a schematic view with an apex approximately 20 degrees after top dead center.
Figure 27F:
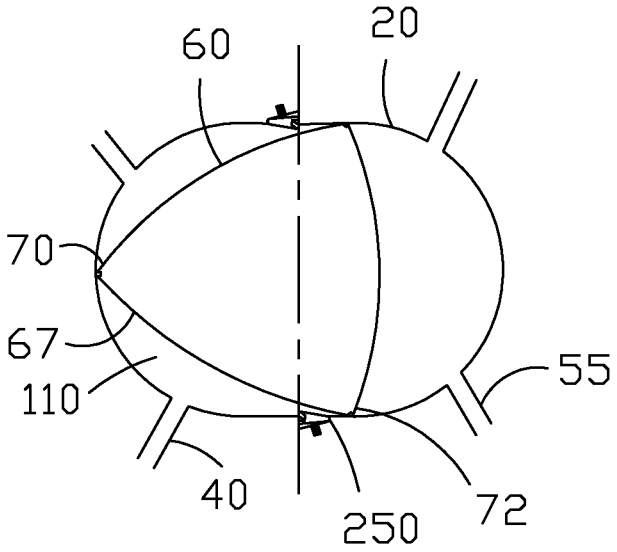
FIG. 27F is a schematic view with an apex approximately 30 degrees after top dead center, wherein the bottom gate ceases to seal the bottom expansion chamber.

An alternative gate 450 is illustrated in FIGS. 17, 22 and 23. Gate 450 has ends 451 and 452. Gate 450 can be a flat piece of spring steel that bends or pivots. The gate is biased to be flat, but can be bent or pivoted to contact the rotor 60. In this embodiment, a slot or slit can form the opening in the radius and the gate 450 can be press fit or adhesively held within the opening. It is appreciated that the gate 450 projects from the housing wall in a slanted manner toward the adjacent inlet and away from the adjacent outlet.

Gate 460 can be provided and is similar to gate 450.

It is understood that the portions of the gates within the housing are movable. It is preferred that the gates are movable from a first gate position wherein the gate is flush with the housing wall to other positions wherein the gate either contacts the rotor or is projected into an expansion chamber without contacting the rotor. The gates preferably are operable to rotate in the same direction as the rotor. This allows pressure to press the gates against the rotor, as well as allowing the rotor to slide over the gates.

Figure 16A:
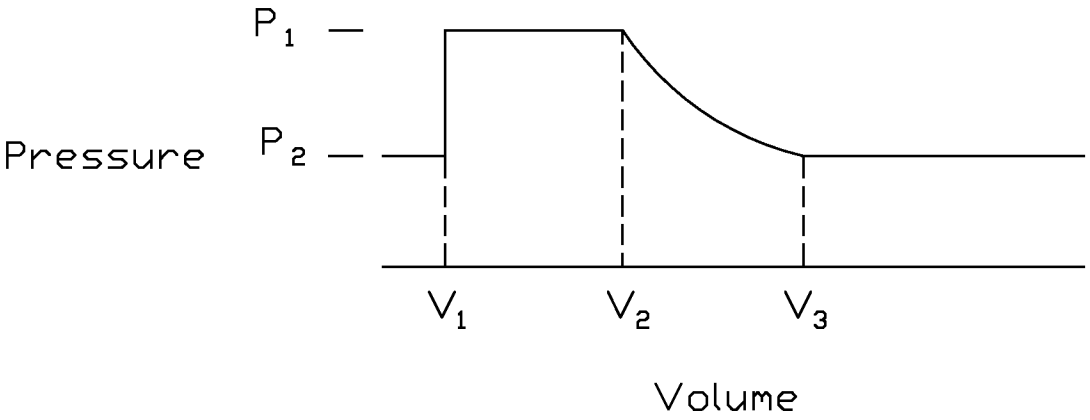
FIG. 16A is a chart showing Pressure vs. Volume within an expansion chamber of the present invention.
Figure 16B:
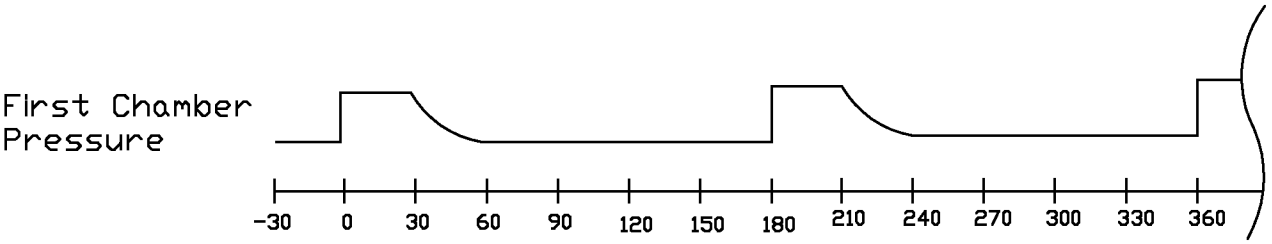
FIG. 16B is a chart showing pressure within an expansion chamber as apex A moves around the housing.
Figure 16C:
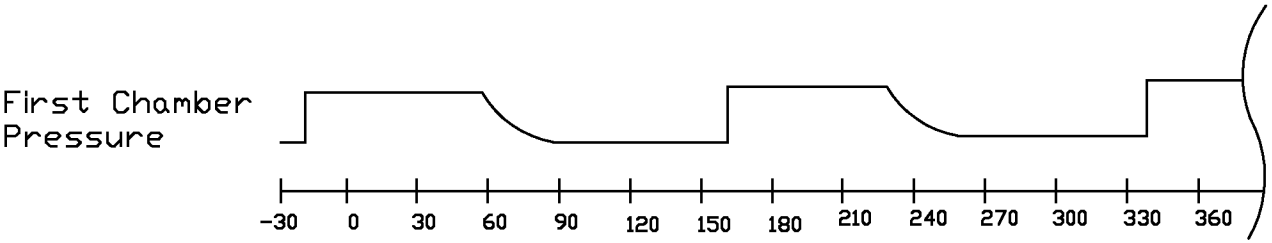
FIG. 16C is similar to FIG. 16B, but shows an increased pressure throughout the revolution of apex A.

As seen in FIG. 16, there are three volumes, V1, V2 and V3 respectively that occur at different times for each of the three expansion chambers of the rotor 60.

V1 is that volume occurring when an inlet valve opens. This occurs when the leading apex passes an inlet and the trailing edge passes an exhaust.

V2 occurs when the rotor advances a sufficient amount to a maximum efficiency point. The maximum efficiency point occurs when the input valve closes at a volume so that the high pressure gas entering the expansion chamber is allowed to fully expand and be equal to the pressure on the low pressure side of the system when the leading apex reaches the exhaust port and the volume is at V3.

Figure 4:
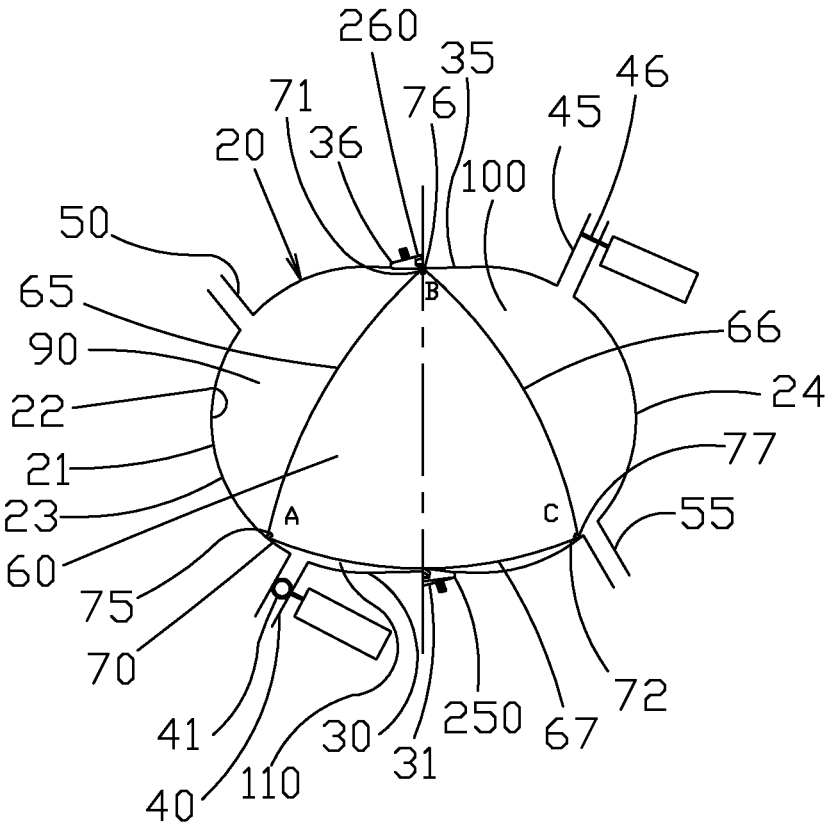
FIG. 4 is a top view showing the rotor in selected position within the housing.
Figure 5:
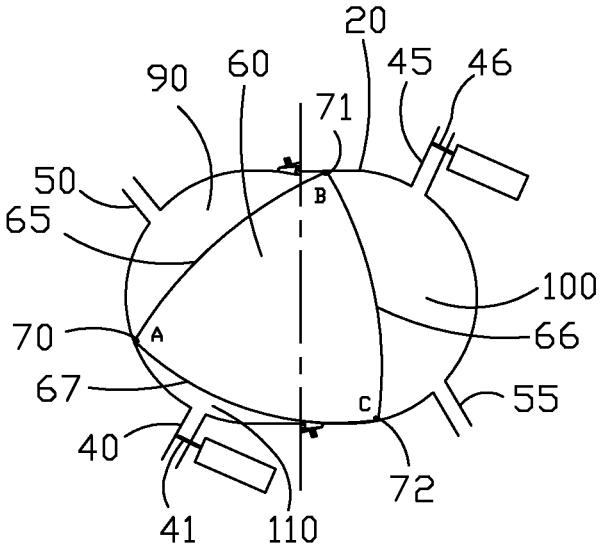
FIG. 5 is a top view showing the rotor in selected position within the housing.
Figure 6:
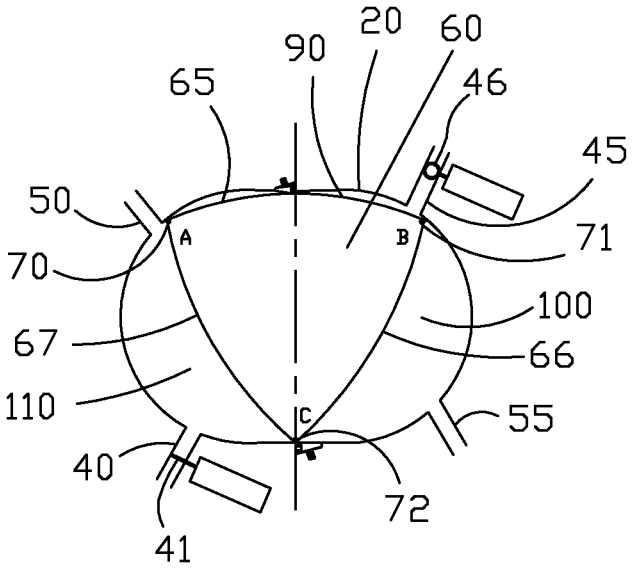
FIG. 6 is a top view showing the rotor in selected position within the housing.
Figure 7:
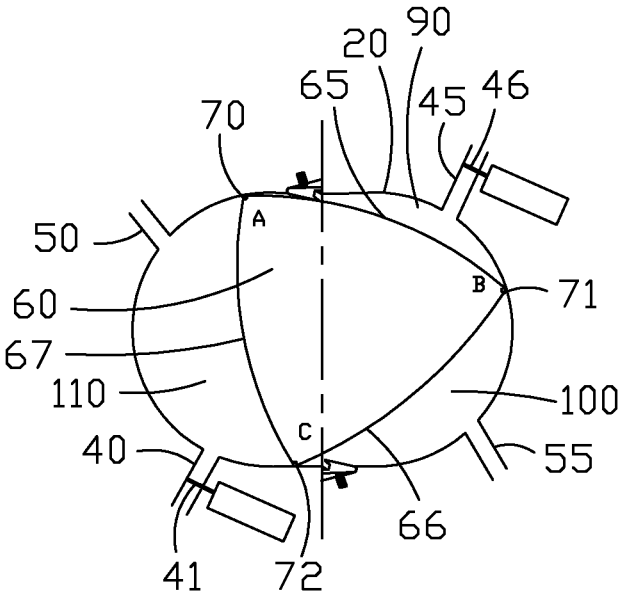
FIG. 7 is a top view showing the rotor in selected position within the housing.
Figure 8:
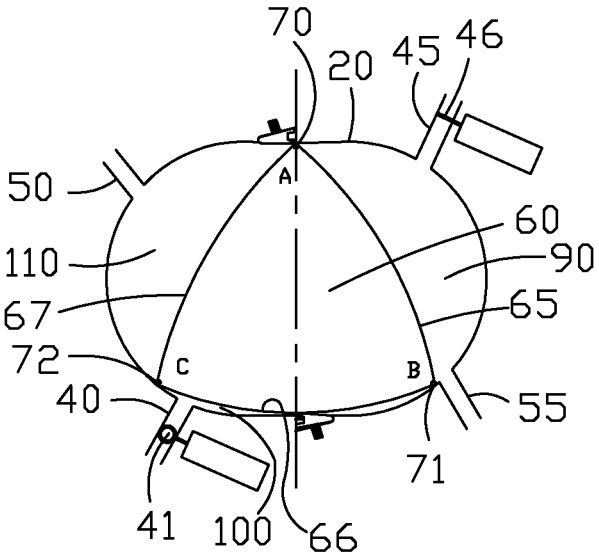
FIG. 8 is a top view showing the rotor in selected position within the housing.
Figure 9:
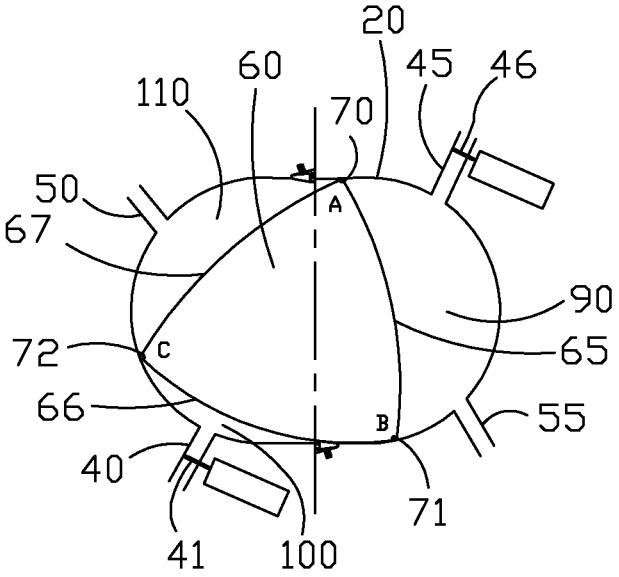
FIG. 9 is a top view showing the rotor in selected position within the housing.
Figure 10:
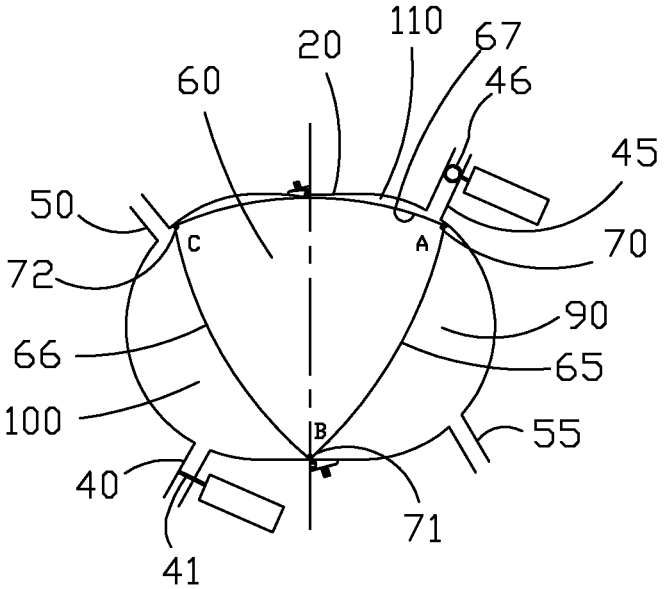
FIG. 10 is a top view showing the rotor in selected position within the housing.
Figure 11:
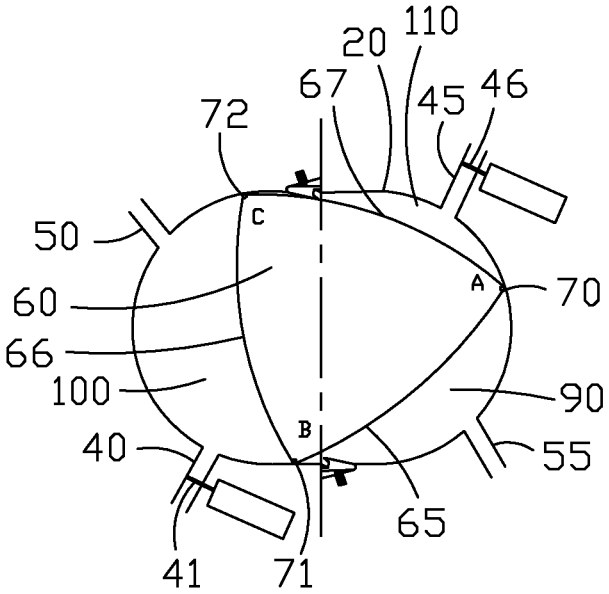
FIG. 11 is a top view showing the rotor in selected position within the housing.
Figure 12:
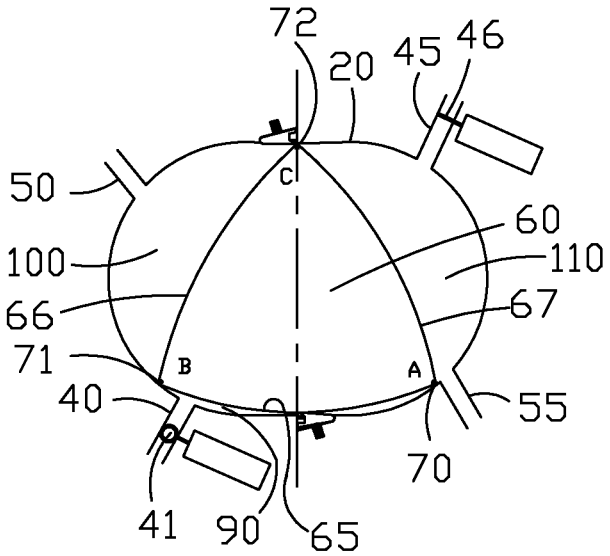
FIG. 12 is a top view showing the rotor in selected position within the housing.
Figure 13:
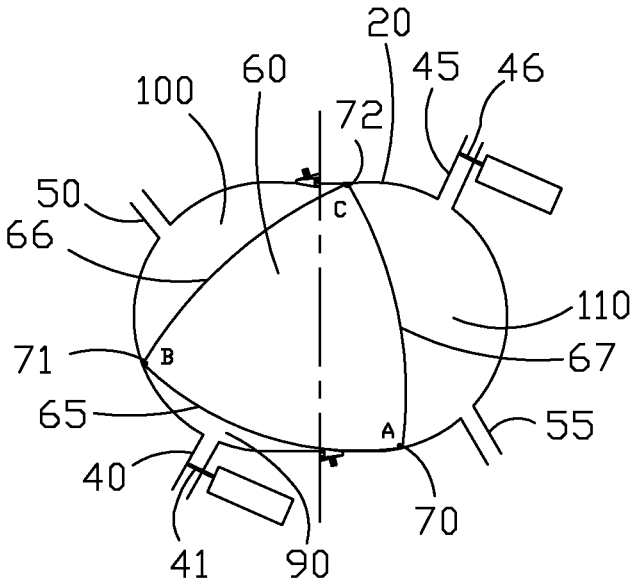
FIG. 13 is a top view showing the rotor in selected position within the housing.
Figure 14:
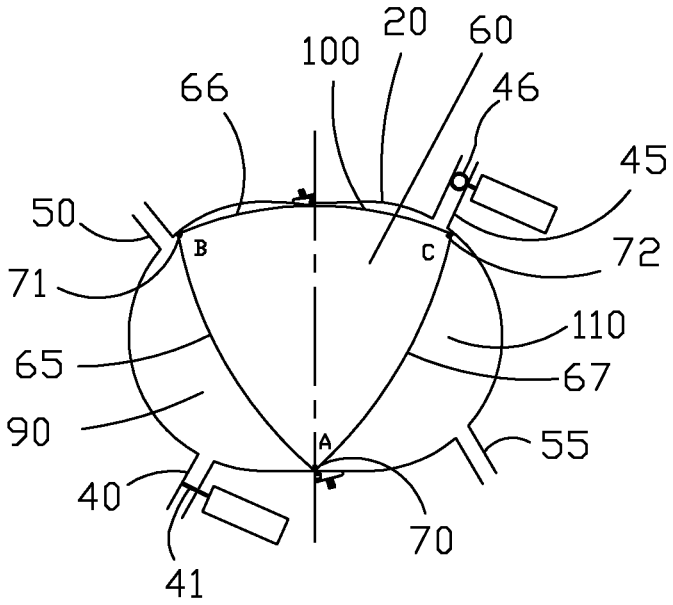
FIG. 14 is a top view showing the rotor in selected position within the housing.
Figure 15:
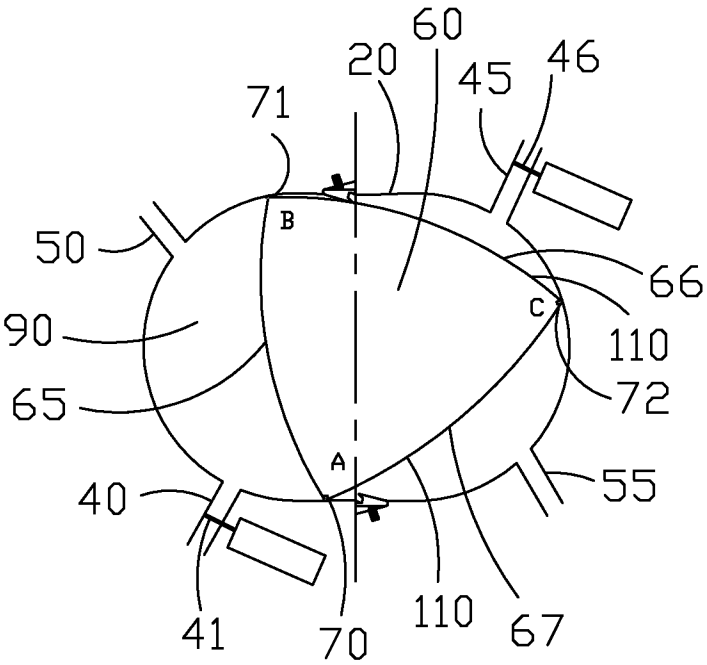
FIG. 15 is a top view showing the rotor in selected position within the housing.

FIGS. 4-15 represent a full cycle of the rotor 60 within the housing 20. The state of each expansion chamber as shown in these drawings is shown in the following table:

| | Expansion Chamber 1 | Expansion Chamber 2 | Expansion Chamber 3 |
|---|---|---|---|
| FIG. 4 | Fully exhausted | V3 | V1 |
| FIG. 5 | Fully exhausted | Fully exhausted | V2 |
| FIG. 6 | V1 | Fully exhausted | V3 |
| FIG. 7 | V2 | Fully exhausted | Fully exhausted |
| FIG. 8 | V3 | V1 | Fully exhausted |
| FIG. 9 | Fully exhausted | V2 | Fully exhausted |
| FIG. 10 | Fully exhausted | V3 | V1 |
| FIG. 11 | Fully exhausted | Fully exhausted | V2 |
| FIG. 12 | V1 | Fully exhausted | V3 |
| FIG. 13 | V2 | Fully exhausted | Fully exhausted |
| FIG. 14 | V3 | V1 | Fully exhausted |
| FIG. 15 | Fully exhausted | V2 | Fully exhausted |

It is appreciated from studying of the above-chart that there are six power cycles per revolution of the rotor 60 within the housing 20.

As means of an example only, at V2, the volume can be 1 unit and the pressure 4 units. Then, at V3, the volume can be 4 units and the pressure 1 unit. Likewise, the pressure external of the expansion chamber is 1 unit. In this regard, the pressure inside and outside of the expansion chamber are equal at V3. The timing of the opening and closing of the input valves is determined by the processor whereby this result is achieved.

FIG. 16B shows graphically pressure within the first chamber as a function of the location of apex A 70 relative the housing (in degrees of rotation).

FIG. 16 C shows graphically the pressure within the first chamber as a function of the location of apex A 70 with an elongated driving force due to 1) opening the valve approximately 20 degrees earlier and closing approximately 20 degrees later. Both early opening and late closing are allowed by the gate.

Figure 19:
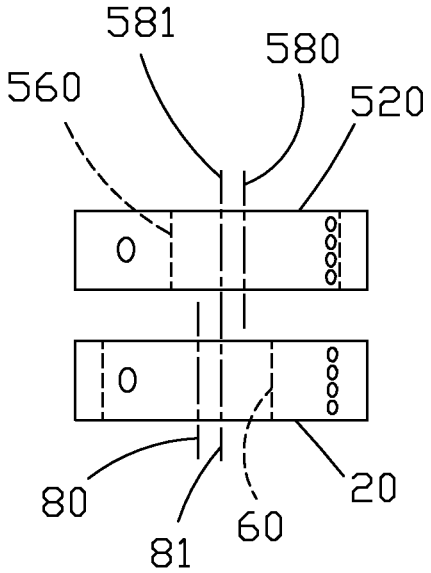
FIG. 19 is similar to FIG. 18, but shows two housings with rotors in opposed positions.

Turning now to FIG. 19, it is seen that a second housing 520 and rotor 560 can be provided. The rotor 560 has a center point 580 and the housing has fulcrum 581. The housing 520 is preferably oriented similarly as housing 20. In this regard, the respective rotors are offset from each other, which allows an engine with two housings to drive an offset crankshaft.

Figure 28:
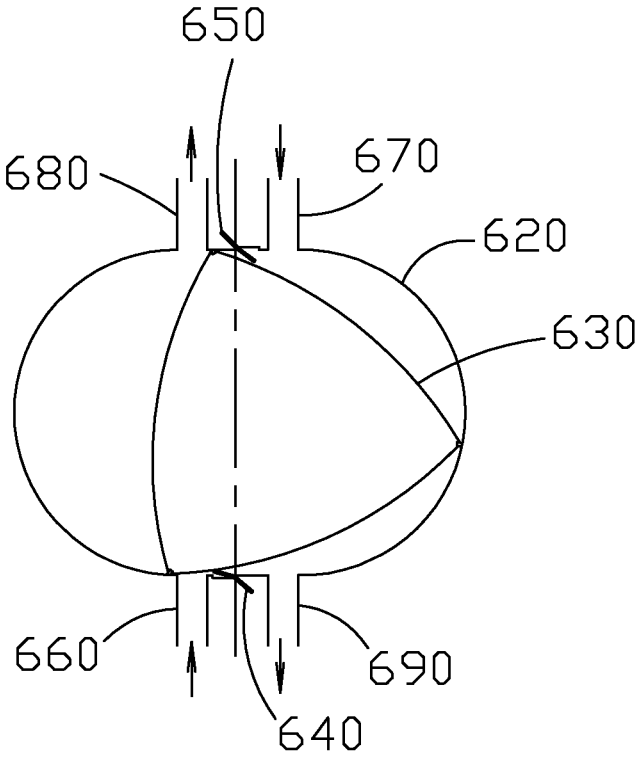
FIG. 28 is a schematic view showing alternative inlet and exhaust locations.

Turning now to FIG. 28, it is seen that a housing 620 is provided. The housing 620 has a rotor 630 and gates 640 and 650. The gates allow inlets 660 and 670 and outlets 680 and 690 to be located at alternative locations about the perimeter of the housing 620. In particular, the gates and alternative exhaust locations allow for larger exhaust volumes, which in turn allow for elongated driving forces to be applied (high pressure applied longer in the cycle so that exhaust pressures are equal).

Also, the gates allow the exhaust to be much closer to the next successive inlet, as the gate prevents back-flowing within an expansion chamber as it bifurcates the expansion chamber. The inlet valves can also be opened earlier in the cycle thereby elongating the driving force. In this regard, in an embodiment without a valve, the inlet valve can be opened with the trailing apex passes the exhaust port. However, when a gate is provided, there is no way for the gas to reach the exhaust port and the valve can be opened before the trailing apex passes the exhaust port.

Figure 21:
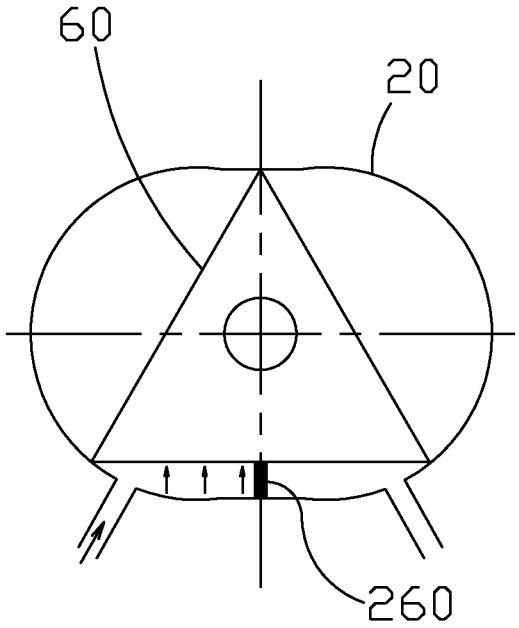
FIG. 21 shows pressure being applied to ½ of the rotor, wherein an expansion chamber is bisected by a gate.

Looking now at FIG. 21, it is seen that if an equilateral triangle were centered within the housing, that it would be equidistant between the inlet and outlet. Further, a center line from the top apex of the triangle to the center point of the base would pass directly through the fulcrum of the housing. If there was no gate, adding pressure at this point in rotation would lead to a locked rotor (equal pressure on each side of the fulcrum) The solutions to this problem are either 1) retarding the input until the trailing apex passes the outlet or 2) adding the gate to block gas and hence pressure from being able to act on the triangle behind the gate. Hence, all of the pressure acts on the first side of the triangle which applies a force to move the triangle in clockwise orientation.

It is appreciated that the engine 10 of the present invention is able to power many types of devices. Two examples are as an automobile engine and as a means to extract energy out of an existing heating system such as a building heating system.

One typical building heating system is a furnace. In this regard, the current furnace simply burns fuel and uses the waste heat to warm a building. By installing a heat engine, the fuel would still be burned, but the heat energy from said burning is used to propel the heat engine, such as the heat engine of the present invention, which can be used to generate electric power via generator.

The waste heat contained in the gas exiting the exhausts is still routed through the condensation chamber 180. Yet, heat exchanger 185 can be used to draw heat from the condensation chamber 180 and transfer it to a building via the building HVAC system. In this regard, the heat of the exhaust gas is not lost, and not dissipated generally. Instead, the dissipated heat is redirected to the building to fulfill the environmental requests of the HVAC system.

Thus it is apparent that there has been provided, in accordance with the invention, a heat engine that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A heat engine comprising:

a housing having an inlet and an inlet valve, and an outlet, said inlet valve being one of opened and closed, wherein said inlet valve is opened to allow a high pressure gas to enter said housing;

a rotor, said rotor having an apex A, an apex B and an apex C;

an expansion chamber between said housing, said apex A and said apex B of said rotor;

a high pressure tank supplying said high pressure gas to said inlet;

a low pressure exhaust system connected to said outlet having a low pressure exhaust system pressure, wherein:

said expansion chamber has an expansion chamber first volume and an expansion chamber first pressure immediately before said inlet valve is opened to allow said high pressure gas to enter said expansion chamber through said inlet;

said expansion chamber has an expansion chamber second volume and an expansion chamber second pressure immediately after said inlet valve is closed to prevent said high pressure gas from further entering said expansion chamber through said inlet when said apex A is between said inlet and said outlet; and said expansion chamber has an expansion chamber third volume and an expansion chamber third pressure immediately before said apex A reaches said outlet, a product of said expansion chamber second volume times said expansion chamber second pressure is approximately equal to a product of said expansion chamber third volume times said expansion chamber third pressure, and said expansion chamber third pressure within said expansion chamber when said expansion chamber has said expansion chamber third volume is approximately equal to said low pressure exhaust system pressure.

2. The heat engine of claim 1 further comprising a processor, said processor determining when said inlet valve closes.

3. The heat engine of claim 1 further comprising:

a heat source supplying heat to said high pressure tank causing a working medium to change from a liquid to a gas;

a condensation chamber draining to a condensation tank; and a pump returning said liquid to said high pressure tank.

4. The heat engine of claim 3 further comprising a return line between said pump and said high pressure tank that is routed near said low pressure exhaust system, said heat engine further comprising a heat exchanger to transfer heat from said low pressure exhaust system to said fluid in said return line.

5. The heat engine of claim 1 further comprising a gate, wherein:

said rotor has a rotor center line, said housing has a fulcrum, said rotor center line is offset from said fulcrum, and said gate closes said expansion chamber causing an increased amount of pressure to act against a positive side of said fulcrum.

6. A heat engine comprising:

a housing having a first inlet, a first inlet valve, a first outlet, a second inlet, a second inlet valve and a second outlet, said first inlet being adjacent to said second outlet and said second inlet being adjacent to said first outlet;

a rotor, said rotor having an apex A, an apex B and an apex C and having a first face, a second face and a third face;

a first expansion chamber between said housing and said first face;

a second expansion chamber between said housing and said second face; and a third expansion chamber between said housing and said third face, wherein at least one of said first expansion chamber, said second expansion chamber and said third expansion chamber is exposed to either said first inlet and said first outlet simultaneously or to said second inlet and said second outlet simultaneously, whereby blow-by is prevented by said first inlet valve closing said first inlet and said second inlet valve closing said second inlet when said rotor is in selected locations relative to said housing.

7. The heat engine of claim 6 wherein when said apex B is at a top dead center position, said first expansion chamber is exposed to both said first inlet and said first outlet.

8. The heat engine of claim 7 wherein said housing is generally epitrochoid-shaped and said rotor is generally reuleaux-shaped.

9. The heat engine of claim 6 further comprising a gate, wherein:

gas passes through said first inlet into said first expansion chamber when said apex A passes said first inlet;

said rotor has a rotor center line, said housing has a fulcrum, said rotor center line is offset from said fulcrum, and said gate presses against said rotor between said apex A and said apex B causing an increased amount of pressure to act against a positive side of said fulcrum.

10. The heat engine of claim 6 wherein:

said first outlet has a first outlet pressure outside of said first outlet;

said first expansion chamber has a first expansion chamber first volume and a first expansion chamber first pressure immediately before said first inlet valve is opened after said apex A passes said first inlet;

said first expansion chamber has a first expansion chamber second volume and a first expansion chamber second pressure immediately after said first inlet valve is closed when said apex A is between said first inlet and said first outlet; and said first expansion chamber has a first expansion chamber third volume and a first expansion chamber third pressure immediately before said apex A reaches said first outlet, a product of said first expansion chamber second volume times said first expansion chamber second pressure is approximately equal to a product of said first expansion chamber third volume times said first expansion chamber third pressure, and said first expansion chamber third pressure within the first expansion chamber when said first expansion chamber has said first expansion chamber third volume is approximately equal to said first outlet pressure.

* * * * *